US008171696B2

(12) United States Patent
Powers, III et al.

(10) Patent No.: US 8,171,696 B2
(45) Date of Patent: May 8, 2012

(54) METAL STUD

(76) Inventors: John Powers, III, Phoenix, AZ (US); Edward Sucato, Phoenix, AZ (US)

( * ) Notice: Subject to any disclaimer, the term of this patent is extended or adjusted under 35 U.S.C. 154(b) by 237 days.

(21) Appl. No.: 12/275,914

(22) Filed: Nov. 21, 2008

(65) Prior Publication Data

US 2010/0126097 A1 May 27, 2010

(51) Int. Cl.
*E04C 3/02* (2006.01)
*E04C 3/00* (2006.01)
*E04H 12/00* (2006.01)

(52) U.S. Cl. ..... 52/691; 52/690; 52/693; 52/694; 52/650.1; 52/846; 52/851; 52/856

(58) Field of Classification Search ..... 52/690, 52/691, 693, 694, 650.1, 836, 846, 848, 856, 52/851
See application file for complete search history.

(56) References Cited

U.S. PATENT DOCUMENTS 1,737,601 A * 12/1929 Macomber ..... 52/376
1,879,295 A * 9/1932 Kahn ..... 52/376
1,952,235 A * 3/1934 Cameron ..... 52/691
2,136,071 A * 11/1938 Braden ..... 52/694
2,180,317 A * 11/1939 Davis ..... 52/319
2,246,215 A * 6/1941 Nagin et al. ..... 52/692
3,221,467 A * 12/1965 Henkels ..... 52/690
4,937,997 A * 7/1990 Thomas et al. ..... 52/693
7,797,908 B2 * 9/2010 Keys ..... 52/846

* cited by examiner

*Primary Examiner* — Brian Glessner
*Assistant Examiner* — Omar Hijaz
(74) *Attorney, Agent, or Firm* — Parsons & Goltry; Robert A. Parsons; Michael W. Goltry

(57) ABSTRACT

A metal stud including first and second metal panels defining first and second flat surfaces with longitudinal edges each turned inwardly away from the flat surfaces. The first and second panels are positioned in parallel spaced apart relationship with the first flat surface and the second flat surface being outwardly directed relative to each other. An angular metal coupling element includes a continuous length of metal material periodically bent in opposite directions. The coupling element is positioned between the first and second panels and bent to periodically and alternately contact the first and second panels at contact points. The coupling element is fixed to the first and second panels at the contact points by spot welding or the like.

16 Claims, 5 Drawing Sheets

METAL STUD

FIELD OF THE INVENTION

This invention generally relates to metal studs for the building industry.

BACKGROUND OF THE INVENTION

Studs, purlins, joists, beams, rafters, etc. are terms used to describe various framing and support components in the building industry. For purposes of simplification and better understanding, the term "stud" or "studs" will be used generically in this disclosure to represent any framing or support component. In the building industry today wooden studs are used almost exclusively. Wooden studs are a weak point in the industry, since wood is not only expensive but has a tendency to deteriorate over time. Further, wooden studs are subject to the capricious and inconstant tendencies of the growth producing the wood. Many wooden studs have knots and irregularities that substantially weaken their supporting ability and, thus, weaken an entire structure.

Some metal studs have been proposed in the past but in each instance the proposed structure is very complicated and difficult to manufacture. An example of a prior art metal stud is disclosed in U.S. Pat. No. 2,089,023, entitled "Fabricated Metal Stud", issued Aug. 3, 1937. In prior art metal studs of this type struts are angled between parallel spaced apart rails that from the outer surfaces of the stud. The struts are affixed to the rails by lugs that are formed from cutting into the side of each rail and bending the cuts inwardly. The struts have notches formed therein that receive the lugs to hold the entire structure together. Thus, it can be seen that the precise cutting of the rails to form the lugs and the precise formation of the notches in the struts entails substantial labor and precision that results in a relatively high cost for the metal studs.

It would be highly advantageous, therefore, to remedy the foregoing and other deficiencies inherent in the prior art.

Accordingly, it is an object of the present invention to provide a new and improved metal stud.

It is another object of the present invention to provide a new and improved metal stud that is constructed to form consistent and reliable support.

It is another object of the present invention to provide a new and improved metal stud that is easy to manufacture and relatively inexpensive to use in the building industry.

SUMMARY OF THE INVENTION

Briefly, to achieve the desired objects of the instant invention in accordance with a preferred embodiment thereof, provided is a metal stud including first and second spaced apart metal panels each having longitudinal edges turned to provide support along the longitudinal axis. An angular metal coupling element is positioned between the first and second spaced apart metal panels and bent to periodically and alternately contact the first and second spaced apart metal panels at contact points. The angular metal coupling element is fixed to the first and second spaced apart metal panels at the contact points.

The desired objects of the instant invention are further achieved in accordance with another embodiment thereof, in which a metal stud includes first and second spaced apart metal panels each having longitudinal edges turned to provide support along the longitudinal axis. One of the longitudinal edges of each of the first and second spaced apart metal panels is turned once to form a side wall and the side walls of the first and second spaced apart metal panels are positioned in opposite or opposed relationship. An angular metal coupling element is positioned between the first and second spaced apart metal panels and bent to periodically and alternately contact the first and second spaced apart metal panels at contact points. The angular metal coupling element is also positioned adjacent the inner surfaces of the upper and lower side walls. The angular metal coupling element is fixed to the first and second spaced apart metal panels at the contact points and to the upper and lower side walls.

The desired objects of the instant invention are further achieved in accordance with a preferred method of fabricating a metal stud including a step of forming a first metal panel defining a first flat surface with two longitudinal edges each turned away from the flat surface and forming a second metal panel defining a second flat surface with two longitudinal edges each turned away from the flat surface and positioning the first metal panel and the second metal panel in parallel spaced apart relationship with the first flat surface and the second flat surface being outwardly directed relative to each other. The method includes a further step of forming an angular metal coupling element including a continuous length of metal material periodically bent in opposite directions to form intended angles between approximately 30° and 90° and positioning the coupling element between the first and second spaced apart metal panels and bent to periodically and alternately contact the first and second spaced apart metal panels at contact points. The method further includes a step of fixing the angular metal coupling element to the first and second spaced apart metal panels on a side opposite the first and second flat surfaces at the contact points.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
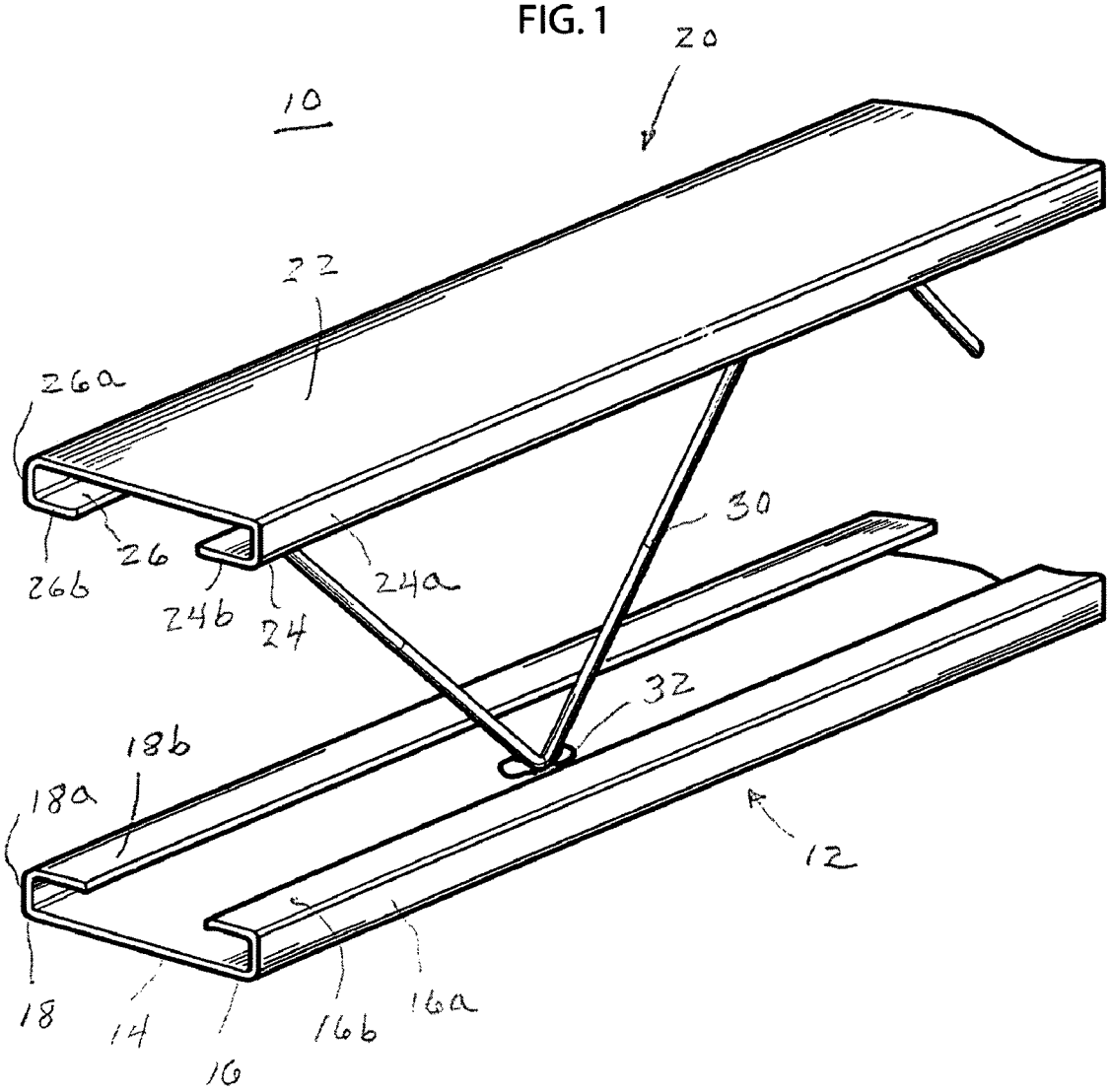
FIG. 1 is an enlarged view in perspective of a metal stud, portions thereof removed, in accordance with the present invention.
Figure 2:
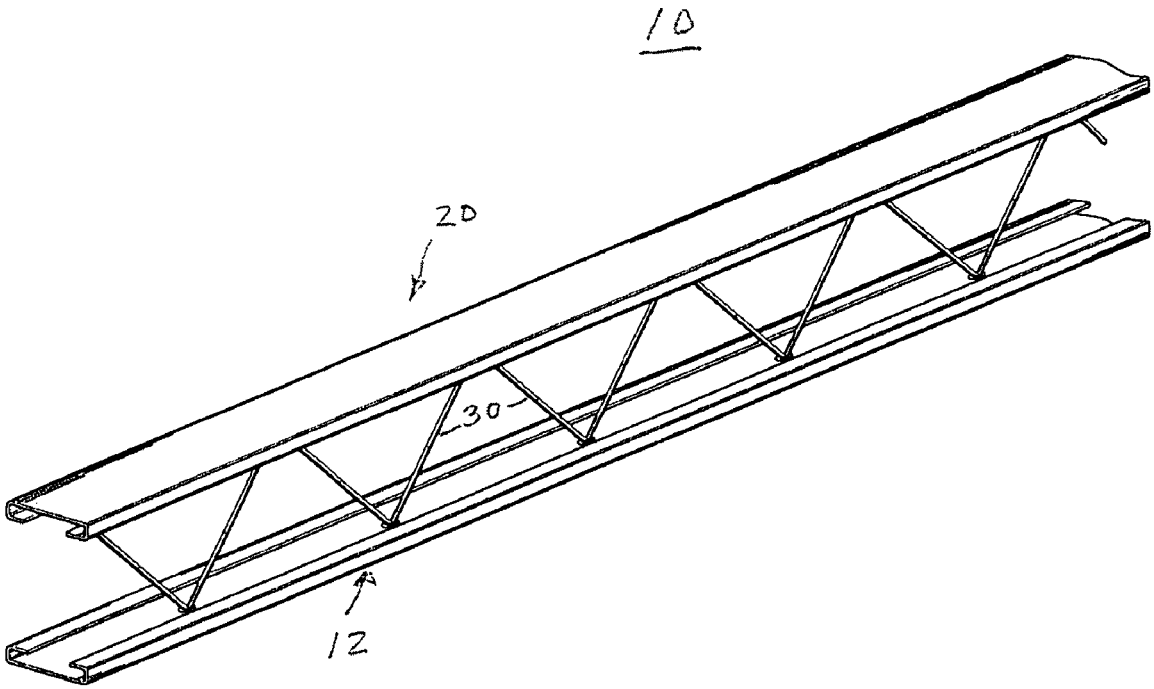
FIG. 2 is a view in top plan of the metal stud of FIG. 1.
Figure 3:
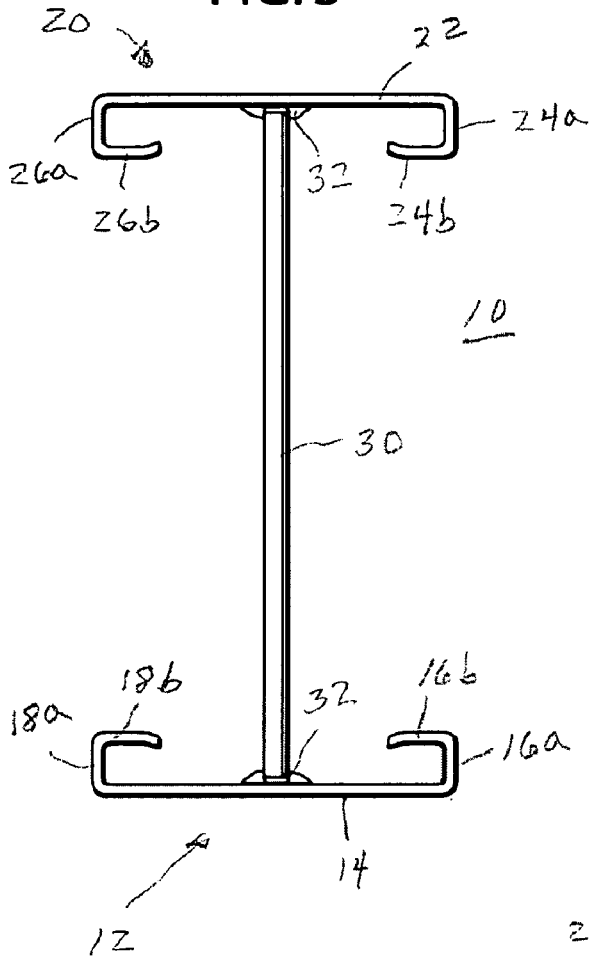
FIG. 3 is an enlarged end view illustrating internal component layout of the metal stud of FIG. 1.
Figure 4:
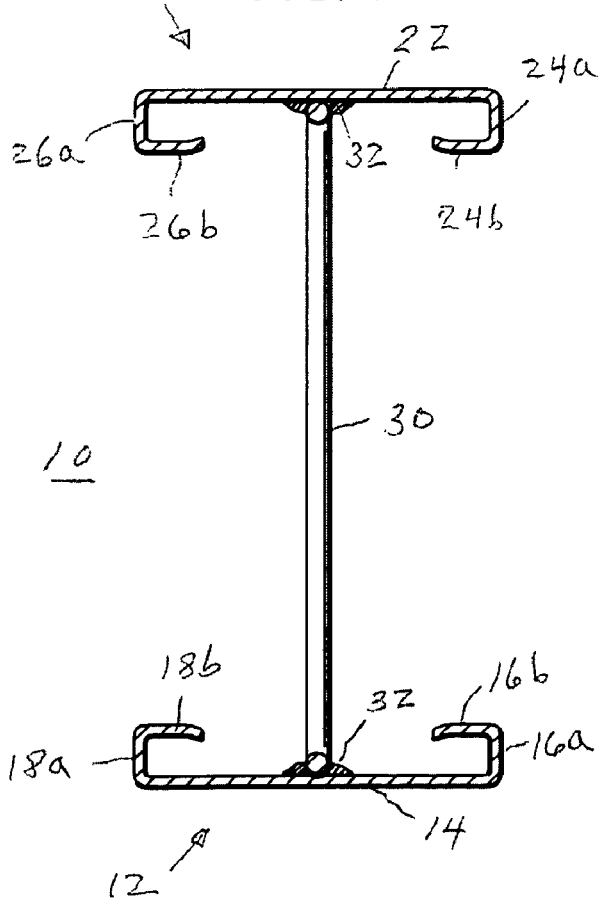
FIG. 4 is an enlarged sectional end view illustrating component layout of the metal stud of FIG. 3.
Figure 5:
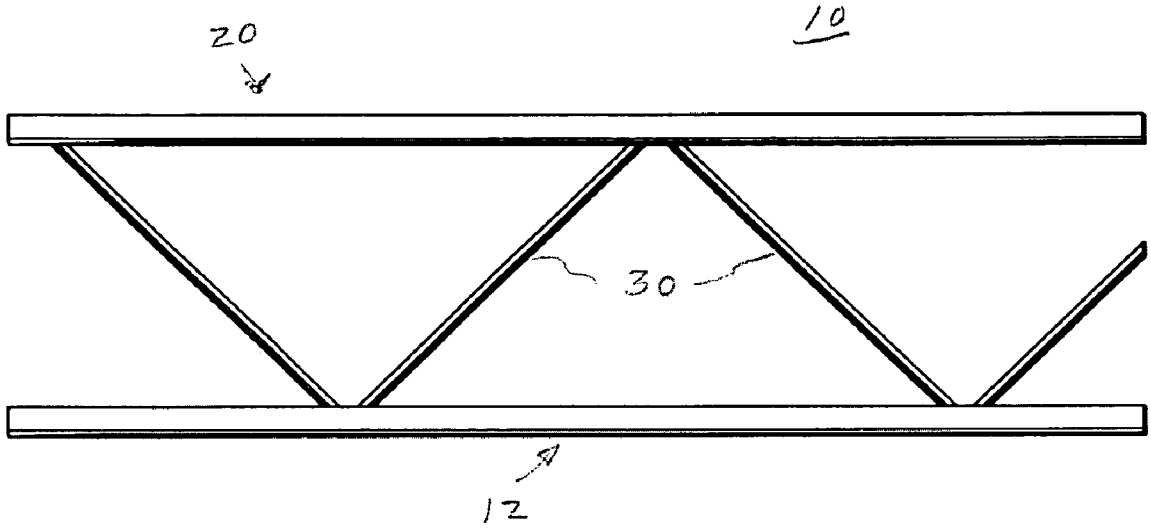
FIG. 5 is a side view of the metal stud of FIG. 1.
Figure 6:
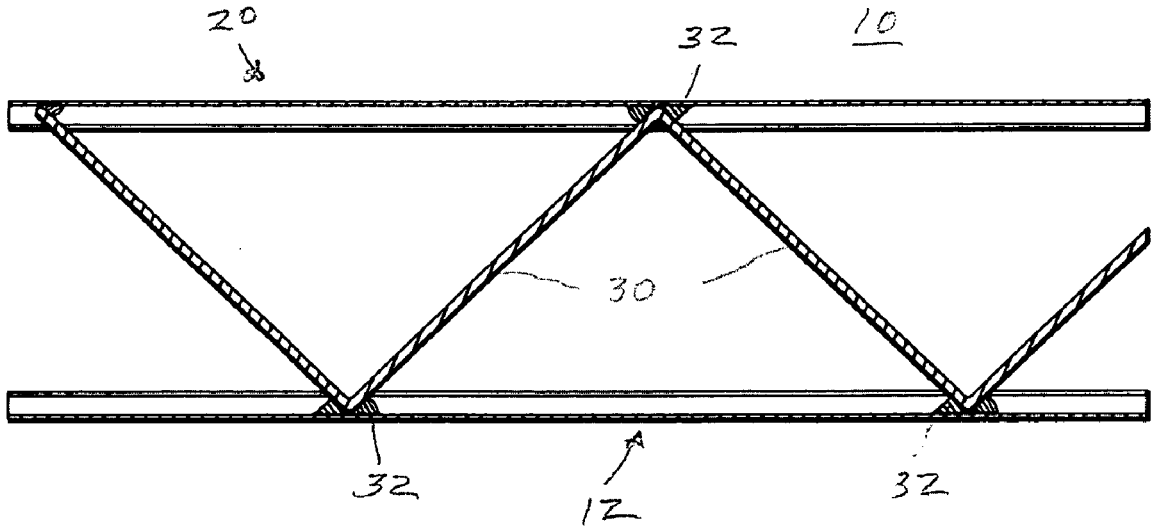
FIG. 6 is a side sectional view of the metal stud of FIG. 5.

Turning now to FIGS. 1-6 in which like components are designated with like numbers, a metal stud 10 is illustrated in accordance with the present invention. Metal stud 10 includes a lower panel 12 forming a lower flat stud surface 14 with opposed edges 16 and 18 turned upwardly at 16*a* and 18*a* and inwardly at 16*b* and 18*b*, respectively, for the length of panel 12. As will be recognized by those of ordinary skill in the art, the turned edges provide strength to metal stud 10. Also, while two ninety degree bends on each edge are illustrated in conjunction with lower panel 12 for simplicity of understanding and manufacture, it will be understood that other bends might be incorporated in special circumstances or applications (e.g. see FIG. 7 and explanation below).

Metal stud 10 also includes an upper panel 20 forming an upper flat stud surface 22 with opposed edges 24 and 26 turned downwardly at 24*a* and 26*a* and inwardly at 24*b* and 26*b*, respectively, for the length of panel 20. As will be recognized by those of ordinary skill in the art, the turned edges provide strength to metal stud 10. Also, while two ninety degree bends on each edge are illustrated in conjunction with upper panel 20 for simplicity of understanding and manufacture, it will be understood that other bends might be incorporated in special circumstances or applications.

Generally, lower panel 12 and upper panel 20 can be formed of any convenient metal material, such as a relatively heavy gauge sheet metal (e.g. 16 gauge to 25 gauge) with the specific metal selected for any specific application. For example in applications requiring substantial support the sheet metal selected might be sheet steel while in applications requiring less support but where weight might be a consideration sheet aluminum might be used. Also, throughout this disclosure the terms "lower" and "upper" refer to the components as they are illustrated and in no way are intended to limit the scope.

Lower panel 12 and upper panel 20 are positioned in parallel spaced apart relationship with lower stud surface 14 directed downwardly and upper stud surface 22 directed upwardly. An angular coupling element 30 extends between lower panel 12 and upper panel 20 and is bent periodically at some predetermined angle, generally between 30° and 90°, so as to alternately contact the inner surface of lower panel 12 and the inner surface of upper panel 20 at regular intervals (e.g. six inches). Generally, coupling element 30 is a single continuous length of some relatively heavy gauge wire or metal rod (e.g. 0.100" to 0.200" thick) that is bent to provide desired contact points 32 with the inner surfaces of lower panel 12 and upper panel 20. In this preferred embodiment coupling element 30 is affixed to the inner surfaces of lower panel 12 and upper panel 20 at contact points 32 by some convenient method such as spot welding or the like.

While a single coupling element 30 is illustrated it will be understood by those skilled in the art that two or more coupling elements could be used between panels either space apart transversely or in tandem with alternate angular points of one coupling element fixed to lower panel 12, alternate angular points of a second coupling element fixed to upper panel 20 and the open or unattached angular points of one coupling element affixed to the open or unattached angular points of the other coupling element. In this fashion the distance between lower panel 12 and upper panel 20 is twice the distance of a single coupling element. The open or unattached angular points of the coupling elements can be attached by spot welding or the like.

Generally, metal stud 10 is used as a stud and the support provide is along the longitudinal axis or the length thereof. In this specific usage there is little cross or transverse pressure applied and coupling element 30 can be relatively light since it simply holds lower panel 12 and upper panel 20 in their relative positions. However, it will be recognized by those skilled in the art that in some instances metal stud 10 may be used as a joist or other horizontal element in construction. In these applications more pressure is applied transversely and some benefit may be realized in providing heavier coupling elements 30. For example, in some applications steel rod or the like might be utilized and additional support can be realized through a smaller angle of bend between contact points 32. Also, while a single continuous piece of material is preferred for coupling element 30 to simplify manufacturing, it will be understood that coupling element 30 could be formed in separate portions in specific applications.

Figure 7:
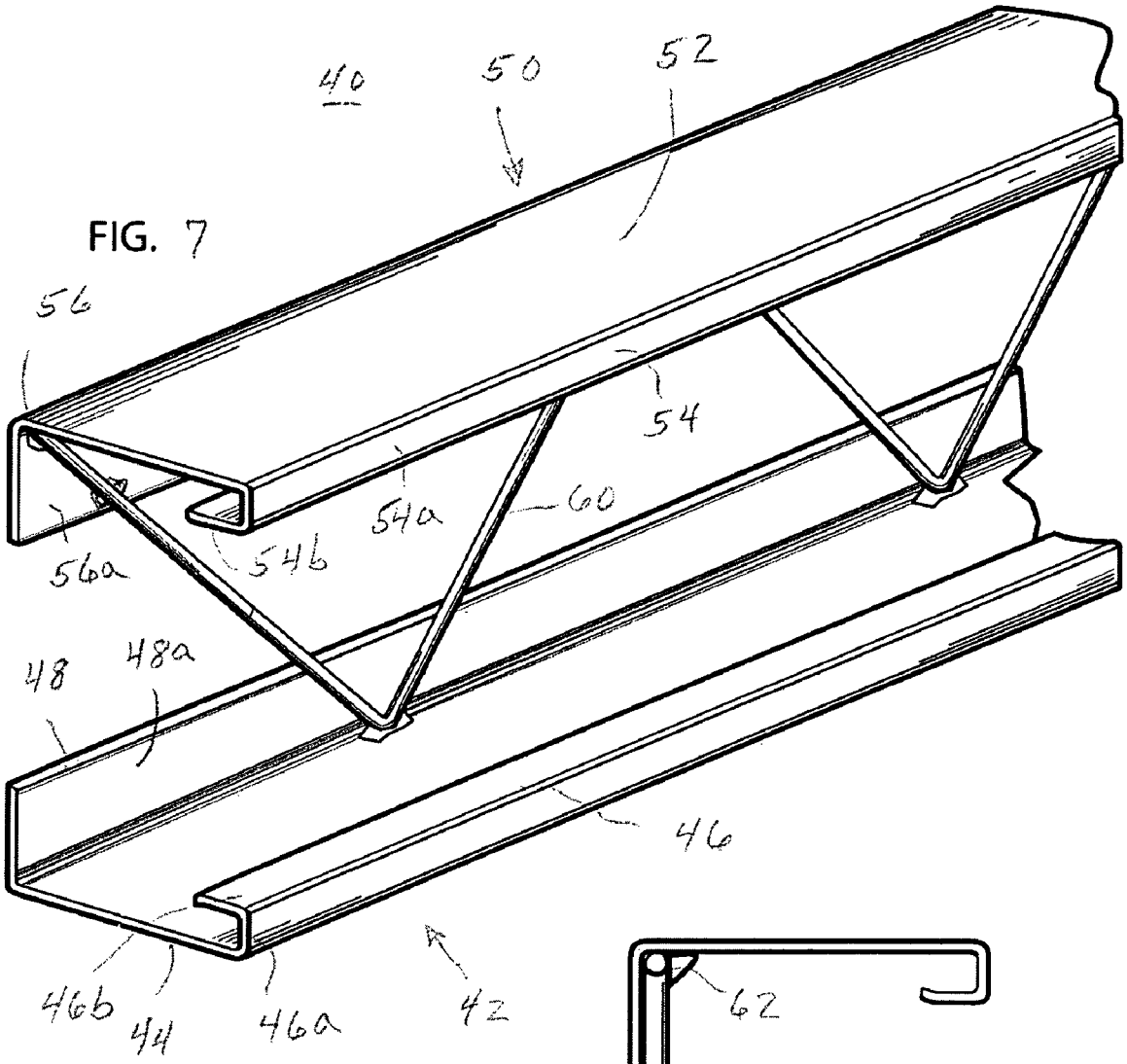
FIG. 7 is a side view in perspective of another embodiment of a metal stud, portions thereof removed, in accordance with the present invention.
Figure 8:
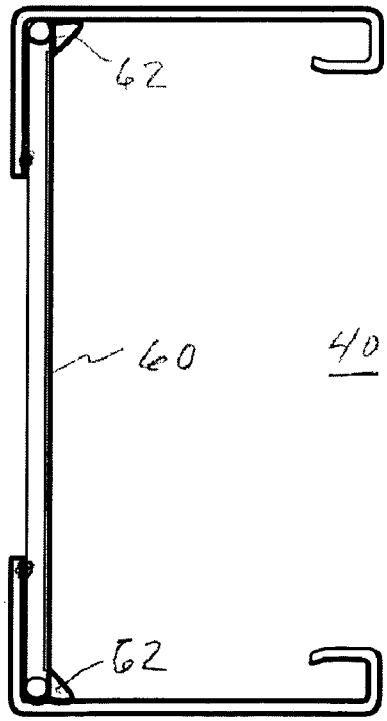
FIG. 8 is an end view of the metal stud illustrated in FIG. 7.

Turning now to FIGS. 7 and 8, another embodiment of a metal stud 40 is illustrated in accordance with the present invention. Metal stud 40 includes a lower panel 42 forming a lower flat stud surface 44 with one edge 46 turned upwardly at 46*a* and inwardly at 46*b*, for the length of lower panel 42. As will be recognized by those of ordinary skill in the art, the turned edge provides strength to metal stud 40. Also, lower panel 42 of metal stud 40 includes an opposing edge 48 turned upwardly at 48*a* a distance greater than the width of portion 46*a* (and in this specific embodiment a distance approximately equal to the combined widths of portions 46*a* and 46*b*), for the length of lower panel 42. For convenience portion 48*a* of lower panel 42 is referred to as a side wall herein.

Metal stud 40 also includes an upper panel 50 forming an upper flat stud surface 52 with one edge 54 turned downwardly at 54*a* and inwardly at 54*b*, for the length of panel 50. As will be recognized by those of ordinary skill in the art, the turned edge provides strength to metal stud 40. Also, upper panel 50 of metal stud 40 includes an opposing edge 56 turned downwardly at 56*a* a distance greater than the width of portion 46*a* (and in this specific embodiment a distance approximately equal to the combined widths of portions 54*a* and 54*b*), for the length of upper panel 50. For convenience portion 56*a* of upper panel 50 is referred to as a side wall herein.

Lower panel 42 and upper panel 50 are positioned in parallel spaced apart relationship with lower stud surface 44 directed downwardly and upper stud surface 52 directed upwardly. An angular coupling element 60 extends between lower panel 42 and upper panel 50 and is bent periodically at some predetermined angle, generally between 30° and 90°, so as to alternately contact the inner surface of lower panel 42 and the inner surface of upper panel 50 at regular intervals (e.g. six inches). In this embodiment coupling element 60 is positioned adjacent turned-up edge 48*a* of lower panel 42 and turned-down edge 56*a* of upper panel 50.

Generally, coupling element 60 is a single continuous length of some relatively heavy gauge wire or metal rod (e.g. 0.100" to 0.200" thick) that is bent to provide desired contact points 62 with the inner surfaces of lower panel 42 and upper panel 50. Also, in this embodiment each span of coupling element 60 is affixed to the inner surface of adjacent turned-up edge 48*a* of lower panel 42 or turned-down edge 56*a* of upper panel 50. In this preferred embodiment coupling element 60 is affixed to the inner surfaces of lower panel 12 and upper panel 20 at contact points 32 and to the adjacent surfaces of edges 48*a* and 56*a* by some convenient method such as spot welding or the like. Fixing coupling element 60 to adjacent turned-up edge 48*a* and turned-down edge 56*a* adds strength and extra support to coupling element 60 for horizontal building components requiring more transverse (vertical) pressure along the span.

Thus, it will be understood that the new and improved metal stud is relatively easy to manufacture since the spaced apart panels can be formed by simple bending steps or by extruding a continuous strip of material. The coupling element is also simple to make because it is preferably a single continuous length of material. Connecting the coupling element to the spaced apart panels can be accomplished by a machine designed to provide the spot welds at regular intervals. Therefore, a new and improved metal stud is disclosed that is constructed to form consistent and reliable support. Further, the new and improved metal stud is easy to manufacture and relatively inexpensive to use in the building industry.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

The invention claimed is:

1. A metal stud comprising:

first and second elongated flat metal panels each having a longitudinal axis and each defining a stud surface and an opposed flat surface, each first and second metal panel having first and second longitudinal edges turned at approximately a ninety degree angle to the stud surface and the opposed flat surface to provide support for the first and second metal panels along the longitudinal axis;

the first and second metal panels positioned in parallel spaced apart relationship with the opposed flat surfaces facing each other and in an overlying laterally aligned relationship with the stud surfaces facing outwardly in opposing directions, and the first and second longitudinal edges of the first metal panel extending toward the first and second longitudinal edges of the second metal panel; and an angular metal wire coupling element positioned between the facing opposed flat surfaces of the first and second spaced apart metal panels, the wire coupling element being bent to periodically and alternately contact the first and second spaced apart metal panels at contact points, the angular metal wire coupling element being fixed to the first and second spaced apart metal panels at the contact points adjacent the first longitudinal edges of the first and second metal panels, the angular metal wire coupling element having a thickness and an angle of bend such that the angular metal wire coupling element provides the sole support between the first and second metal panels, and the first and second spaced apart metal panels and the angular metal wire coupling element forming a generally C-shaped cross-section.

2. A metal stud as claimed in claim 1 wherein each turned first and second longitudinal edge of each first and second spaced apart metal panel includes at least one bend directed away from the outwardly facing stud surface and towards the opposed flat surface, the turned edge of each first and second metal panel extending longitudinally the length of the first and second metal panel, respectively, and the lateral width of each turned edge being less than the lateral width of the stud surface.

3. A metal stud as claimed in claim 2 wherein the turned first longitudinal edge of each first and second spaced apart metal panel includes the first approximately ninety degree bend directed away from the outwardly facing stud surface and a second approximately ninety degree bend forming a turned edge substantially parallel to and spaced from the opposed flat surface.

4. A metal stud as claimed in claim 2 wherein the turned second longitudinal edges of each first and second spaced apart metal panel include a first bend directed away from the outwardly facing stud surface to form a side wall and the angular metal coupling element is affixed to the side walls adjacent the contact points.

5. A metal stud as claimed in claim 1 wherein the first and second spaced apart metal panels are each formed of sheet metal.

6. A metal stud as claimed in claim 1 wherein the first and second spaced apart metal panels are each formed of extruded metal.

7. A metal stud as claimed in claim 1 wherein the angular metal coupling element is a single continuous piece of metal.

8. A metal stud as claimed in claim 7 wherein the single continuous piece of metal forming the angular metal coupling element is periodically and alternately bent in opposite directions at an angle between approximately 30° and 90°.

9. A metal stud comprising:

a first metal panel defining a first flat surface with two longitudinal edges each turned approximately ninety degrees away from the flat surface;

a second metal panel defining a second flat surface with two longitudinal edges each turned approximately ninety degrees away from the flat surface;

the first metal panel and the second metal panel being positioned in parallel overlying laterally aligned and spaced apart relationship with the first flat surface and the second flat surface being outwardly directed relative to each other; and an angular metal wire coupling element including a continuous length of metal wire periodically bent in opposite directions to form intended angles between approximately 30° and 90°, the wire coupling element being positioned between the first and second spaced apart metal panels and bent to periodically and alternately contact the first and second spaced apart metal panels at contact points, the angular metal wire coupling element being fixed to the first and second spaced apart metal panels on a side opposite the first and second flat surfaces at the contact points adjacent the first longitudinal edges of the first and second metal panels, and the angular metal wire coupling element having a thickness and an angle of bend such that the angular metal wire coupling element provides the sole support between the first metal panel and the second metal panel, and the first and second spaced apart metal panels and the angular metal wire coupling element forming a generally C-shaped cross-section.

10. A metal stud as claimed in claim 9 wherein the one of the turned away edges of each of the first and second spaced apart metal panels each includes at least one additional approximately ninety degree bend directed parallel to and spaced from the outwardly directed flat surface.

11. A metal stud as claimed in claim 10 wherein one of the turned away edges of each first and second spaced apart metal panel includes a first approximately ninety degree bend directed away from the outwardly directed flat surface and toward each other to form opposed side walls and the angular metal coupling element is affixed to the side walls adjacent the contact points.

12. A metal stud as claimed in claim 9 wherein the first and second spaced apart metal panels each are formed of sheet metal.

13. A metal stud as claimed in claim 9 wherein the first and second spaced apart metal panels each are formed of extruded metal.

14. A metal stud as claimed in claim 9 wherein a first turned longitudinal edge of each first and second spaced apart metal panel includes a first approximately ninety degree bend directed away from the outwardly facing stud surface and a second approximately ninety degree bend forming a turned edge substantially parallel to and spaced from the opposed flat surface, the first turned edge of each first and second metal panel extending longitudinally the length of the first and second metal panel, respectively, and the lateral width of each first turned edge being less than the lateral width of the flat surface.

15. A metal stud as claimed in claim 1 wherein the angular metal wire coupling element is a relatively heavy gauge wire in a range of 0.100" to 0.200" thick.

16. A metal stud as claimed in claim 1 wherein the angular metal wire coupling element is fixed to the first and second spaced apart metal panels by spot welding.

* * * * *